US009473856B2

(12) United States Patent
Lin et al.

(10) Patent No.: US 9,473,856 B2
(45) Date of Patent: Oct. 18, 2016

(54) PIEZOELECTRIC ELECTROACOUSTIC TRANSDUCER

(71) Applicant: INDUSTRIAL TECHNOLOGY RESEARCH INSTITUTE, Chutung Township, Hsinchu County (TW)

(72) Inventors: Chia-Hsin Lin, Hsinchu (TW); Ching-Iuan Sheu, Hsinchu (TW); Yu-Tsung Chiu, Hsinchu (TW); Chun-Ti Chen, Hsinchu (TW)

(73) Assignee: Industrial Technology Research Intitute, Hsinchu County (TW)

( * ) Notice: Subject to any disclaimer, the term of this patent is extended or adjusted under 35 U.S.C. 154(b) by 0 days.

(21) Appl. No.: 14/530,225

(22) Filed: Oct. 31, 2014

(65) Prior Publication Data

US 2015/0304779 A1 Oct. 22, 2015

(30) Foreign Application Priority Data

Apr. 18, 2014 (TW) ..... 103114152 A

(51) Int. Cl.

*H04R 25/00* (2006.01)
*H04R 17/00* (2006.01)
*H04R 7/20* (2006.01)

(52) U.S. Cl.

CPC ..... *H04R 17/00* (2013.01); *H04R 7/20* (2013.01)

(58) Field of Classification Search

CPC ..... H04R 17/00; H04R 2217/00; H04R 2217/01

See application file for complete search history.

(56) References Cited

U.S. PATENT DOCUMENTS

| | | | |
|---|---|---|---|
| 5,825,902 | A | 10/1998 | Fujishima |
| 6,064,746 | A | 5/2000 | Nakamura et al. |
| 6,453,050 | B1 | 9/2002 | Ogura et al. |
| 6,865,785 | B2 | 3/2005 | Ogura et al. |
| 7,596,235 | B2 | 9/2009 | Michiels |

(Continued)

FOREIGN PATENT DOCUMENTS

| | | | |
|---|---|---|---|
| CN | 1843058 | A | 10/2006 |
| CN | 100358394 | C | 12/2007 |

(Continued)

OTHER PUBLICATIONS

Kim et al., "A Piezoelectric Microspeaker with a High-Quality PMN-PT Single-Crystal Membrane", Journal of the Korean Physical Society, vol. 54, No. 2, Feb. 2009, pp. 930-933.

(Continued)

*Primary Examiner* — Tuan D Nguyen

(74) *Attorney, Agent, or Firm* — Birch, Stewart, Kolasch & Birch, LLP

(57) ABSTRACT

A piezoelectric electroacoustic transducer is disclosed. The piezoelectric electroacoustic transducer includes a diaphragm, a piezoelectric element disposed on the diaphragm, an elastic element connected with and around the diaphragm, a frame around the elastic element and being disassembled so as to adjust an inner-frame projected area of the frame, and a buffer interposed between the elastic element and the frame, wherein the frame has an inner-frame projected area less than a planar projected area of the diaphragm, the elastic element, and the buffer, such that the frame always provides a compressive stress to the diaphragm, the piezoelectric element, the elastic element, and the buffer. The piezoelectric electroacoustic transducer may be implemented as a loudspeaker or a microphone.

20 Claims, 10 Drawing Sheets

(56) References Cited

U.S. PATENT DOCUMENTS

| | | | |
|---|---|---|---|
| 2002/0041694 | A1 | 4/2002 | Michiels |
| 2002/0186860 | A1 | 12/2002 | Ogura et al. |
| 2004/0081326 | A1 | 4/2004 | Michiels |
| 2004/0218769 | A1 | 11/2004 | Kami et al. |
| 2012/0008805 | A1 | 1/2012 | Hachinohe et al. |
| 2012/0163638 | A1 | 6/2012 | Yamauchi et al. |
| 2013/0094681 | A1 | 4/2013 | Fukuoka et al. |
| 2013/0301856 | A1 | 11/2013 | Kim et al. |

FOREIGN PATENT DOCUMENTS

| | | | |
|---|---|---|---|
| CN | 100496057 | C | 6/2009 |
| CN | 100525512 | C | 8/2009 |
| CN | 102265646 | A | 11/2011 |
| CN | 101313628 | B | 6/2012 |
| CN | 10254754 | A | 7/2012 |
| CN | 102823275 | A | 12/2012 |
| EP | 0999723 | A2 | 5/2000 |
| JP | 60-165200 | A | 8/1985 |
| JP | 6-22394 | A | 1/1994 |
| JP | 9-271096 | A | 10/1997 |
| JP | 11-331976 | A | 11/1999 |
| JP | 2001-16692 | A | 1/2001 |
| JP | 2001-285994 | A | 10/2001 |
| JP | 2005-64831 | A | 3/2005 |
| JP | 4975197 | B2 | 7/2012 |
| TW | M415529 | U | 11/2011 |

OTHER PUBLICATIONS

Kim et al., "High Performance Piezoelectric Microspeakers and Thin Speaker Array System", ETRI Journal, vol. 31, No. 6, Dec. 2009, pp. 680-687.

Ko et al., "Piezoelectric Membrane Acoustic Devices", The Fifteenth IEEE International Conference on Micro Electro Mechanical Systems, 2002, pp. 296-299.

Lee et al., "Piezoelectric Cantilever Microphone and Microspeaker", Journal of Microelectromechanical Systems, vol. 5, No. 4, Dec. 1996, pp. 238-242.

Yi et al., "Piezoelectric Microspeaker With Compressive Nitride Diaphragm", The Fifteenth IEEE International Conference on Micro Electro Mechanical Systems, 2002, pp. 260-263.

PIEZOELECTRIC ELECTROACOUSTIC TRANSDUCER

CROSS-REFERENCE TO RELATED APPLICATIONS

This Application claims priority of Taiwan Patent Application No. 103114152, filed on Apr. 18, 2014. The entirety of the above-mentioned patent application is hereby incorporated by reference herein and made a part of this specification.

TECHNICAL FIELD

The present disclosure relates to transducers, and more particularly to a piezoelectric electroacoustic transducer.

BACKGROUND

The piezoelectric speaker generally includes a frame, a diaphragm fixed on the frame with bonding material, and a piezoelectric element attached on the diaphragm.

A piezoelectric speaker as known is used to convert electrical energy into mechanical energy. When AC power is applied to the piezoelectric speaker, a piezoelectric element deforms and drives a diaphragm closed attached thereto to vibrate so as to compress air for producing sounds.

Sound pressure level (SPL) and total harmonic distortion (THD) are the important characteristics of a piezoelectric speaker. The sound pressure is the local pressure deviation from the ambient atmospheric pressure, caused by a sound wave. The total harmonic distortion is a measurement of the harmonic distortion present and is defined as the ratio of the sum of the powers of all harmonic components to the power of the fundamental frequency.

In general, as the piezoelectric element in the piezoelectric speaker vibrates, the energy will waste partially from the piezoelectric element transfer to the frame through the diaphragm and the bonding material which result in a smaller sound pressure level.

Furthermore, the fixed frame of the piezoelectric speaker is easier to cause ripple because of the resonance phenomena of mechanical structure. When a mechanical resonance occurs in the speaker, vibrations arise in a fundamental frequency and its multiples; thereby a sound pressure produced by the speaker would increase in resonance frequency bands and the sound pressure decreases while a distortion increases in non-resonance frequency bands.

Thus, the target of the researchers is to provide a piezoelectric speaker with high sound pressure, low distortion, wide range and a flat sound pressure curvature.

Therefore, how to overcome the above-described drawbacks has become urgent.

SUMMARY

The present disclosure provides a piezoelectric electroacoustic transducer, comprising: a diaphragm, a piezoelectric element disposed on the diaphragm, an elastic element connected with and around the diaphragm, a frame around the elastic element, and a buffer disposed between the elastic element and the frame, wherein the composition of the diaphragm, the elastic element, and the buffer has a planar projected area. The inner-frame projected area is less than a plane projected area of the composition of the diaphragm, the elastic element, and the buffer, such that the frame always provides a compressive stress to the diaphragm, the piezoelectric element, the elastic element, and the buffer.

In an embodiment, the frame could be fixed or disassemble in order to adjust the inner-frame projected area.

The piezoelectric electroacoustic transducer in the present disclosure may exhibit a speaker characteristic for high sound pressure level, flat sound pressure level curvature, and low THD, as well as a microphone function for converting sound wave to electronic signal.

BRIEF DESCRIPTION OF DRAWINGS

The disclosure can be more fully understood by reading the following detailed description of the preferred embodiments, with reference made to the accompanying drawings, wherein.

DETAILED DESCRIPTION

Figure 1A:
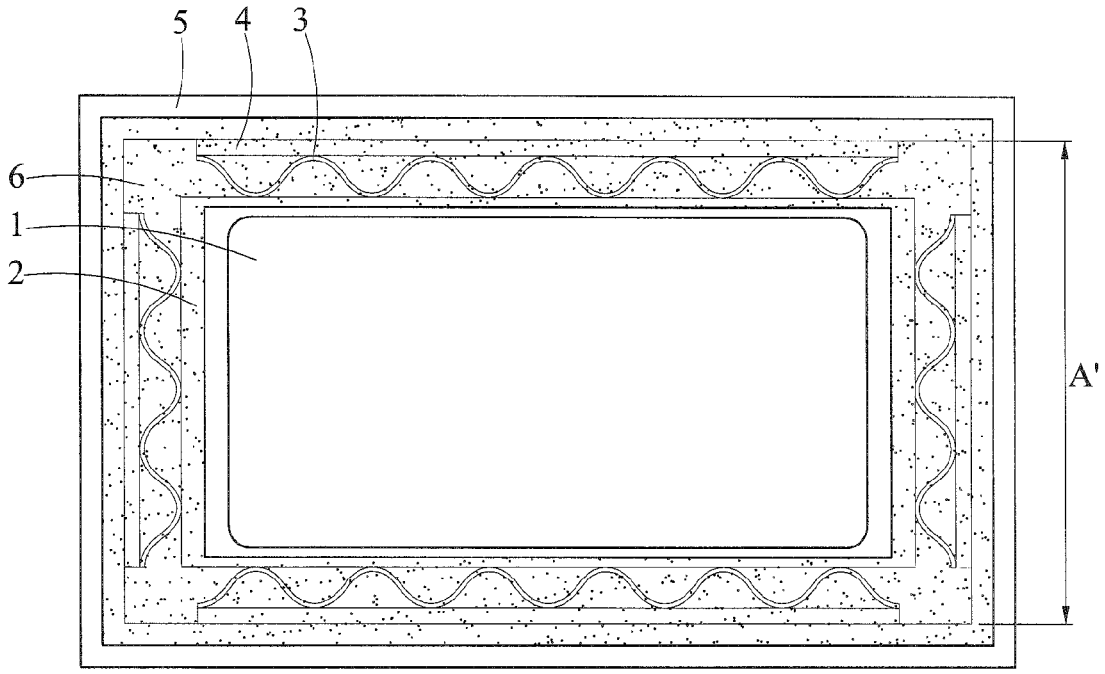
FIGS. 1A-1B are perspective views of a piezoelectric electroacoustic transducer according to the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 1B:
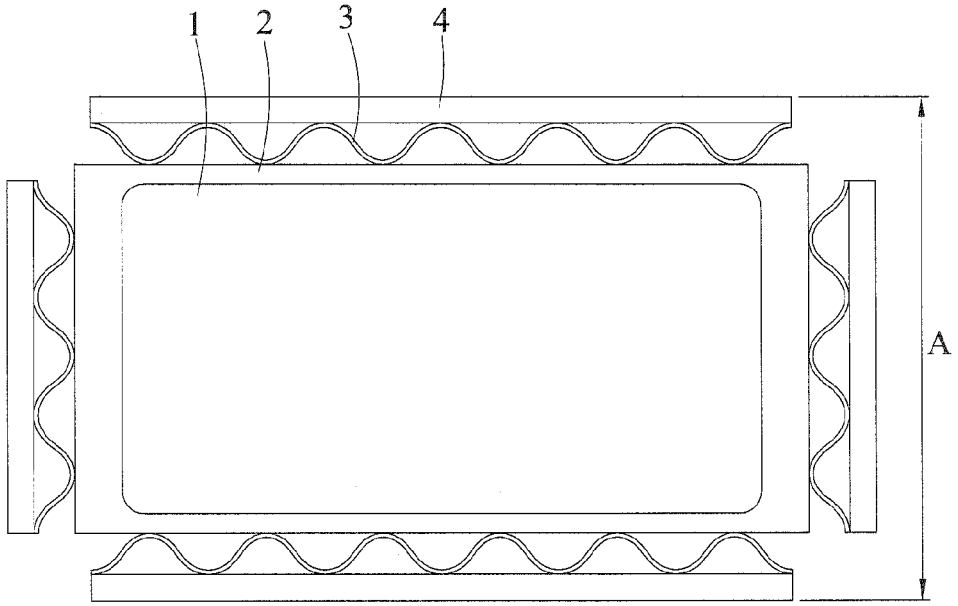
Figure 2:
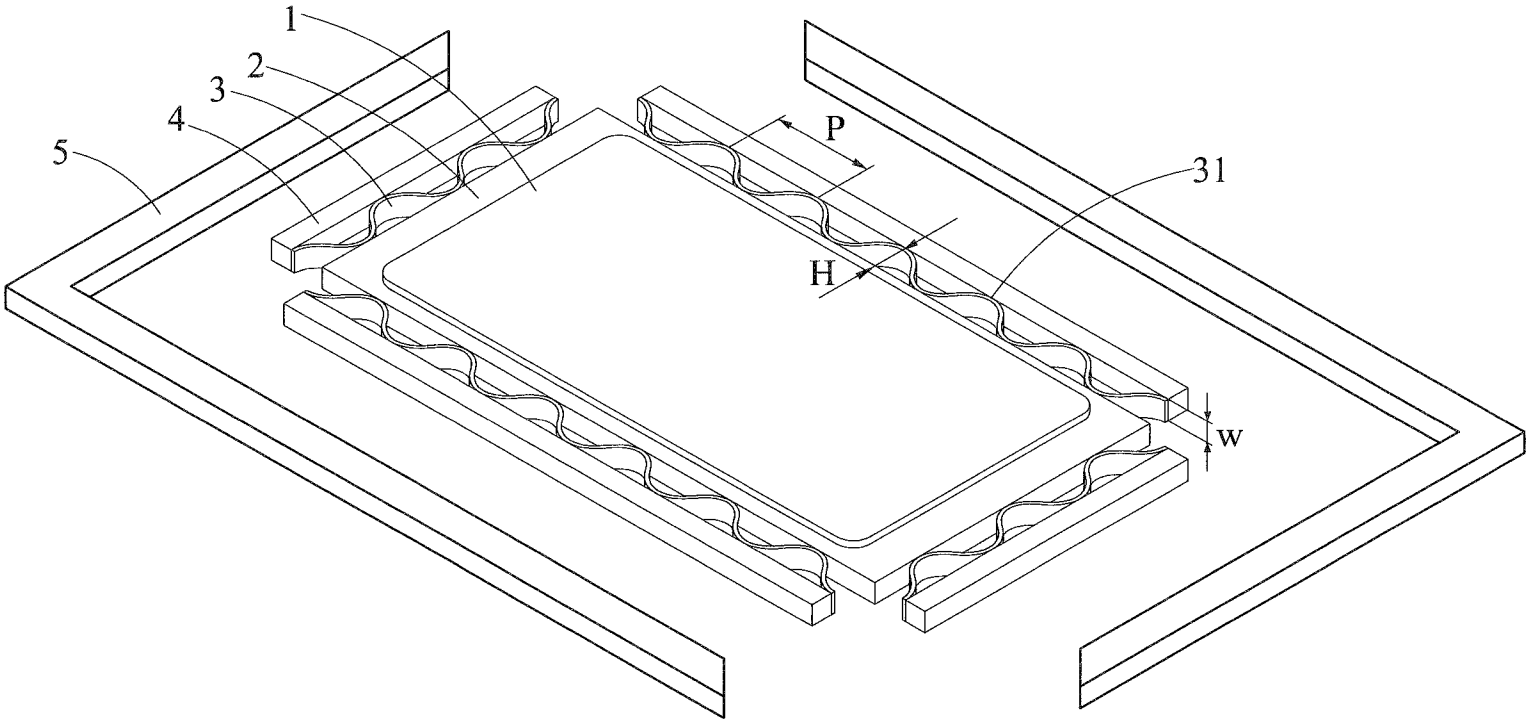
FIG. 2 is a three-dimensional drawing of a piezoelectric electroacoustic transducer according to the present disclosure.
Figure 3A:
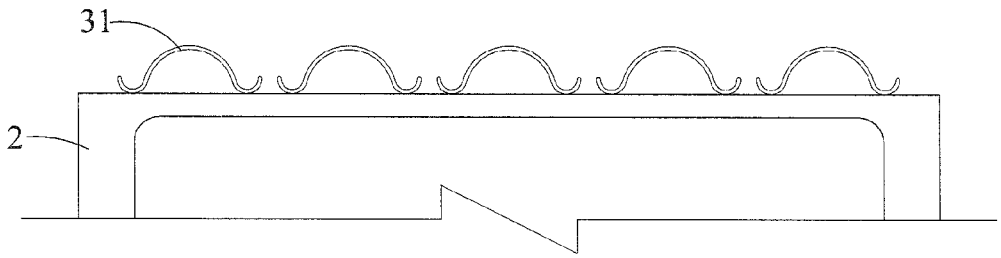
FIGS. 3A-3E are schematic views of bending structure of a piezoelectric electroacoustic transducer according to the present disclosure.
Figure 3B:
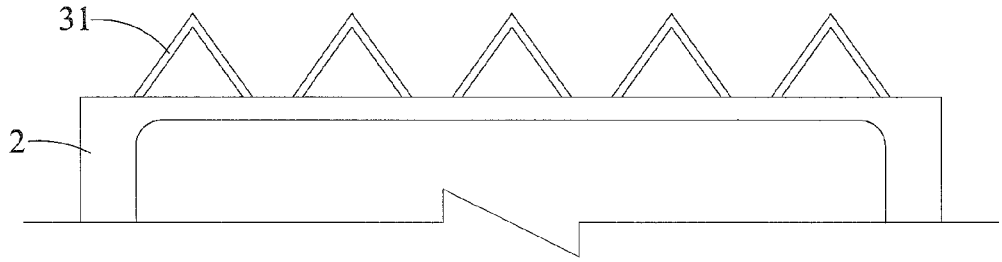
Figure 3C:
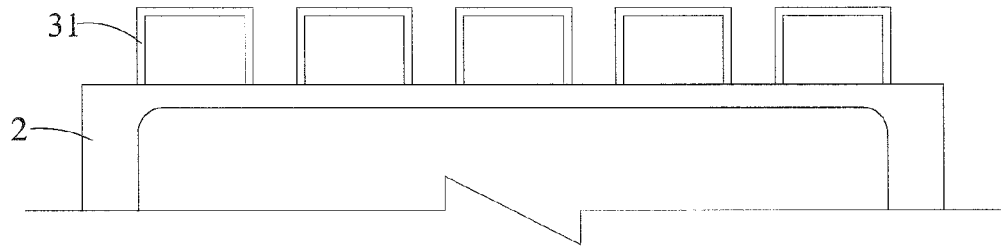
Figure 3D:
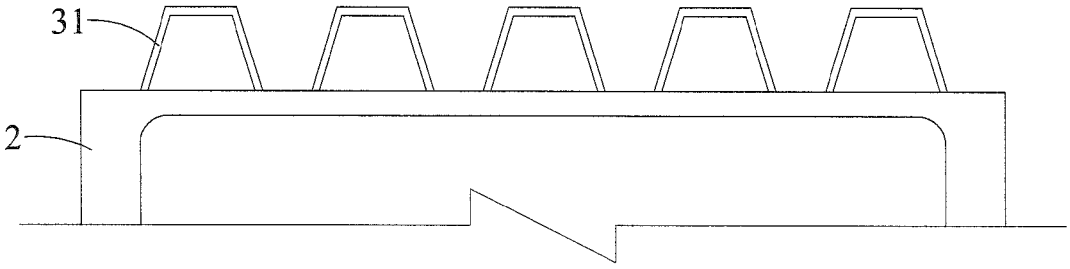
Figure 3E:
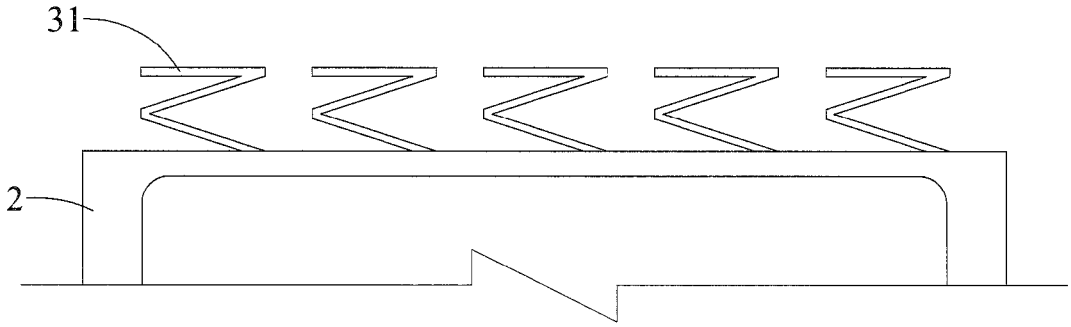

FIGS. 1A and 1B are the perspective view of a piezoelectric electroacoustic transducer according to the present disclosure. FIG. 2 is a three dimensional drawing of a piezoelectric electroacoustic transducer according to the present disclosure. FIGS. 3A to 3E are bending structures of a piezoelectric electroacoustic transducer according to the present disclosure.

The piezoelectric electroacoustic transducer comprises a piezoelectric element 1, a diaphragm 2, an elastic element 3, a buffer 4, a frame 5, and a membrane 6.

The piezoelectric element 1 is provided on at least one side of the diaphragm 2 and may be attached to opposite side of the diaphragm.

The piezoelectric element 1 is a piezoelectric ceramic actuator. The shape of the piezoelectric element 1 is rectangular as illustrated in FIGS. 1 to 2, circular, elliptical, or any other shape.

The diaphragm 2 can be a single layer or multilayer. For instance, the diaphragm is three-layer composite having pressure sensitive adhesive sandwiched between zinc and copper alloys.

The diaphragm 2 is rectangular as illustrated in FIGS. 1 to 2, circular, elliptical or any other shape.

The elastic element 3 is connected with and around the diaphragm 2, and comprises a plurality of bending structure 31. The bending structures are arranged along the periphery of diaphragm, the interval P between the two adjacent bending structures is less than or equal to one-third of the perimeter of the diaphragm (That is, there are at least 3 bending structures 31 along the periphery of diaphragm). For instance, the range of the interval P is from 8 mm to 13 mm. The bending structure height H is 1 mm-4 mm. The bending structure width W is 0.5 mm-2 mm. In addition, the bending structure is continuously arc-shaped as illustrated in FIGS. 1 to 2, separately arc-shaped, triangular, rectangular, or Z-shaped as illustrated in FIGS. 3A to 3E.

The buffer 4 surrounds the outside of the elastic element 3, so as to prevent the elastic element 3 in contact with the frame 5. For instance, the buffer 4 is pressure sensitive polymer, elastic rubber, or foam rubber.

The frame 5 surrounds the outside of the elastic element 3, such that the buffer 4 interposed between the elastic element 3 and the frame 5. The frame 5 is fixed or disassemble so as to adjust an inner-frame projected area A' of the frame 5.

A planar projected area A is formed from the composition of the diaphragm 2, the elastic element 3, and the buffer 4.

The inner-frame projected area A' is less than the planar projected area A, such that the frame always provides a compressive stress to the piezoelectric element 1, the diaphragm 2, the elastic element 3, and the buffer 4. The ratio of the projected area of the inner-frame A' to the planar projected area A is in the range of 0.9 to 1. In addition, the direction of compressive stress provided from the frame 5 to the elastic element 3 is parallel to the plane of the diaphragm 2 and the like.

The membrane 6 covers part of the diaphragm 2 and the frame 5 so as to seal the gap of the diaphragm and the frame.

It is known from FIG. 1 to FIG. 3, because of the inner-frame projected area A' is less than the planar projected area A, such that the frame always provides a compressive stress to the piezoelectric element 1, the diaphragm 2, the elastic element 3, and the buffer 4, and the plurality of bending structure 31 are connected with and around the diaphragm 2, when actuating the piezoelectric element 1 provided on the diaphragm 2, it allows the piezoelectric electroacoustic transducer according to the present disclosure reduce the diaphragm side stiffness, so that the diaphragm 2 has larger displacement or greater acceleration, so as to improve electroacoustic converting capability and create greater sound pressure level and lower total harmonic distortion. In the meanwhile, according to the elastic member 3 of the present disclosure, the diaphragm 2 can withstand the compressive stress within the frame 5 provided in the case of maintaining the deformation, and thus reduce the piezoelectric electroacoustic transducer distortion significantly.

Comparative example and embodiments 1 to 14 are illustrated as follows.

Comparative Example

A diaphragm (85 mm×42 mm×0.1 mm) with a piezoelectric element (75 mm×40 mm×0.1 mm) attached to thereon. A frame surrounds the diaphragm. A flexible foam interposed between the diaphragm and the frame. As the piezoelectric electroacoustic transducer in this example is implemented as a speaker, an electrical parameter for testing is 10 Vrms and a microphone for receiving sound located 10 cm away.

Embodiment 1

Figure 4A:
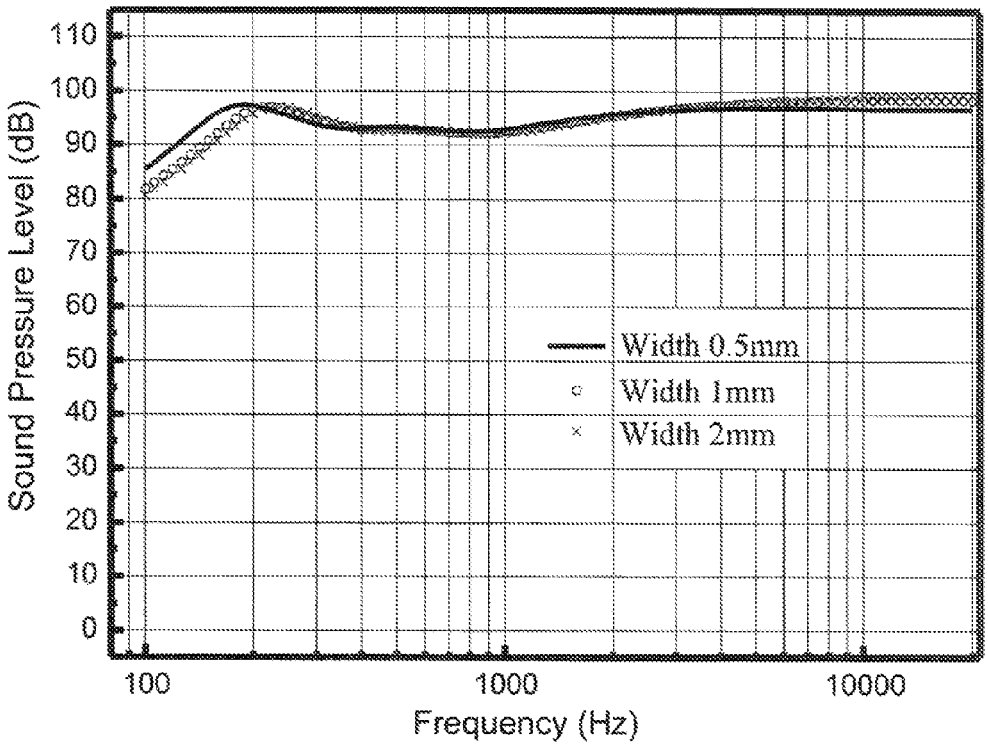
FIGS. 4A-4B are diagrams showing the sound pressure level and total harmonic distortion of a piezoelectric electroacoustic transducer according to embodiments 1, 2, and 3 of the present disclosure.
Figure 4B:
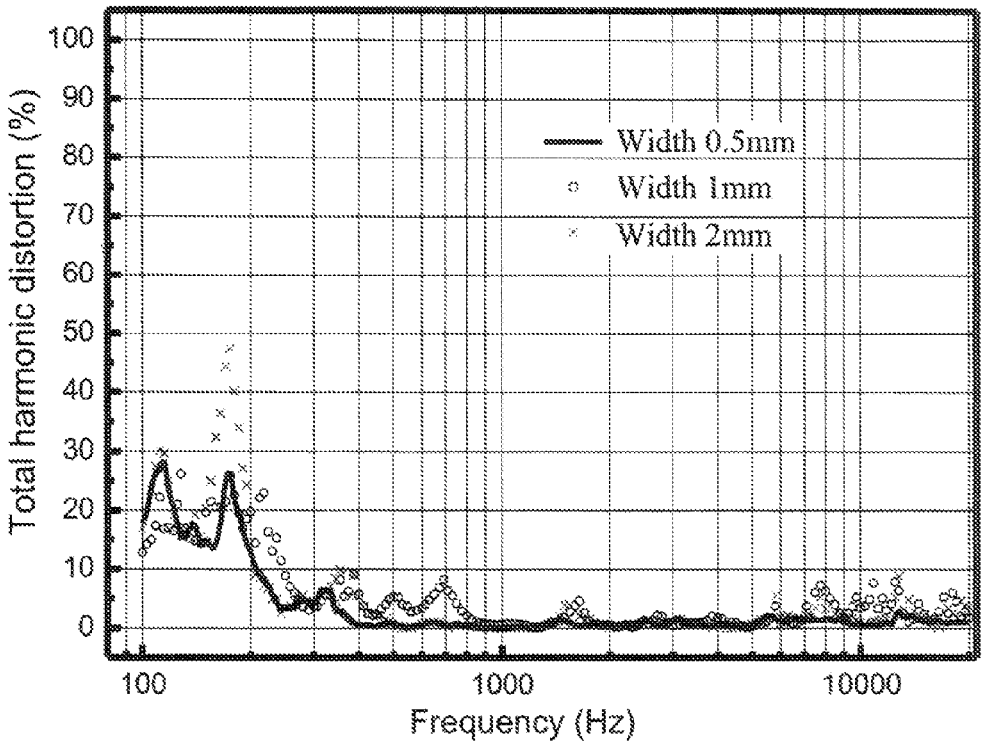

The piezoelectric electroacoustic transducer includes the diaphragm (85 mm×42 mm×0.1 mm), a piezoelectric element (75 mm×40 mm×0.1 mm) attached to diaphragm thereon, an elastic element having a plurality of bending structure surrounds the diaphragm, A frame surrounds the diaphragm, and a buffer interposed between the elastic element and the frame. The interval between the two adjacent bending structures is 10 mm. The bending structure height is 2 mm, and the bending structure width is 0.5 mm. In this embodiment, the bending structure is arc-shaped. The ratio of the projected area of the inner-frame to planar projected area which is the composition of the diaphragm, the elastic element, and the buffer is 1 (this is without applying stress). As the piezoelectric electroacoustic transducer in this embodiment is implemented as a speaker, an electrical parameter for testing is 10 Vrms and a microphone for receiving sound located 10 cm away. The testing results for the sound pressure level (SPL) and the total harmonic distortion (THD) in the embodiment 1 are shown in FIG. 4A and FIG. 4B, respectively.

Embodiment 2

The difference between embodiments 2 and 1 is that the width of the bending structure is 1 mm. The testing results for the sound pressure level and the total harmonic distortion in the embodiment 2 are shown in FIGS. 4A, 4B, 5A, 5B, 6A, 6B, 7A and 7B.

Embodiment 3

The difference between embodiments 3 and 1 is that the bending structure width is 2 mm. The testing results for the sound pressure level and the total harmonic distortion in the embodiment 3 are shown in FIGS. 4A and 4B, respectively.

Embodiment 4

Figure 5A:
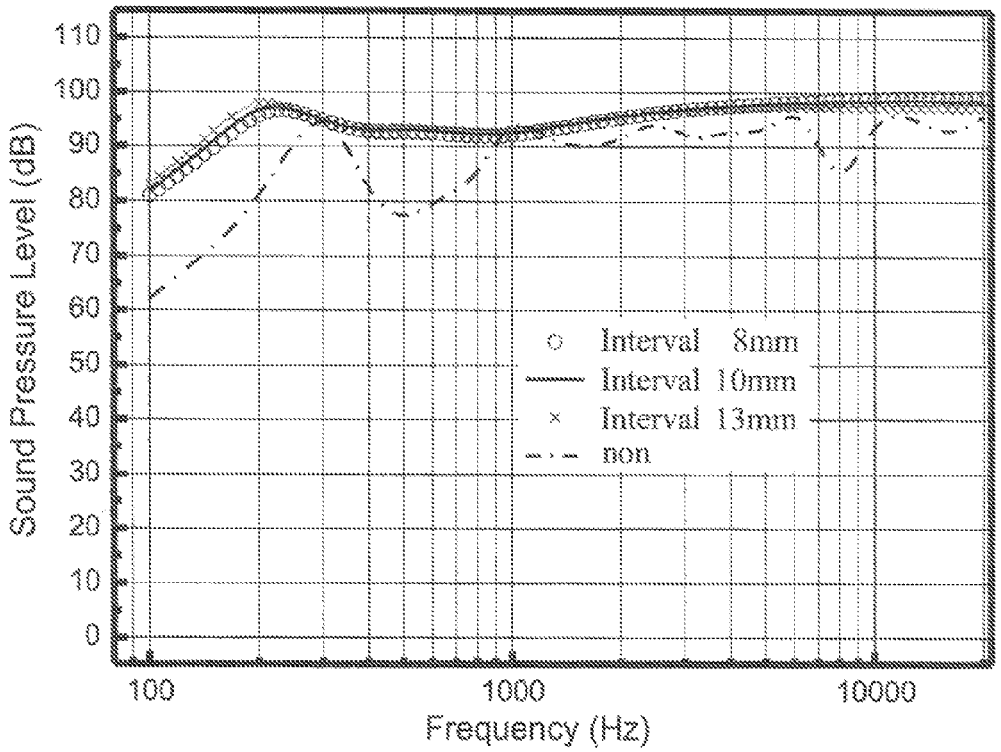
FIGS. 5A-5B are diagrams showing the sound pressure level and total harmonic distortion of a piezoelectric electroacoustic transducer according to embodiments 2, 4, and 5 of the present disclosure.
Figure 5B:
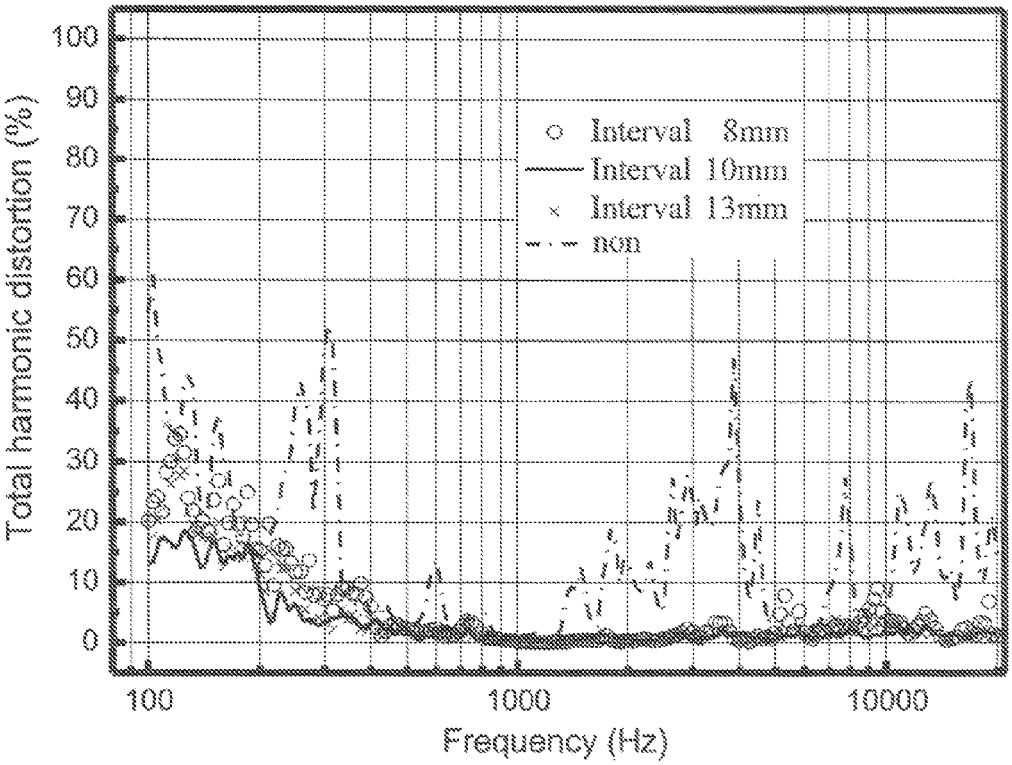

The difference between embodiments 4 and 1 is that the interval P between the two adjacent bending structures is 8 mm. The testing results for the sound pressure level and the total harmonic distortion in the embodiment 4 are shown in FIGS. 5A and 5B, respectively.

Embodiment 5

The difference between embodiments 5 and 1 is that the interval between the two adjacent bending structures is 13 mm. The testing results for the sound pressure level and the total harmonic distortion in the embodiment 5 are shown in FIGS. 5A and 5B, respectively.

Embodiment 6

Figure 6A:
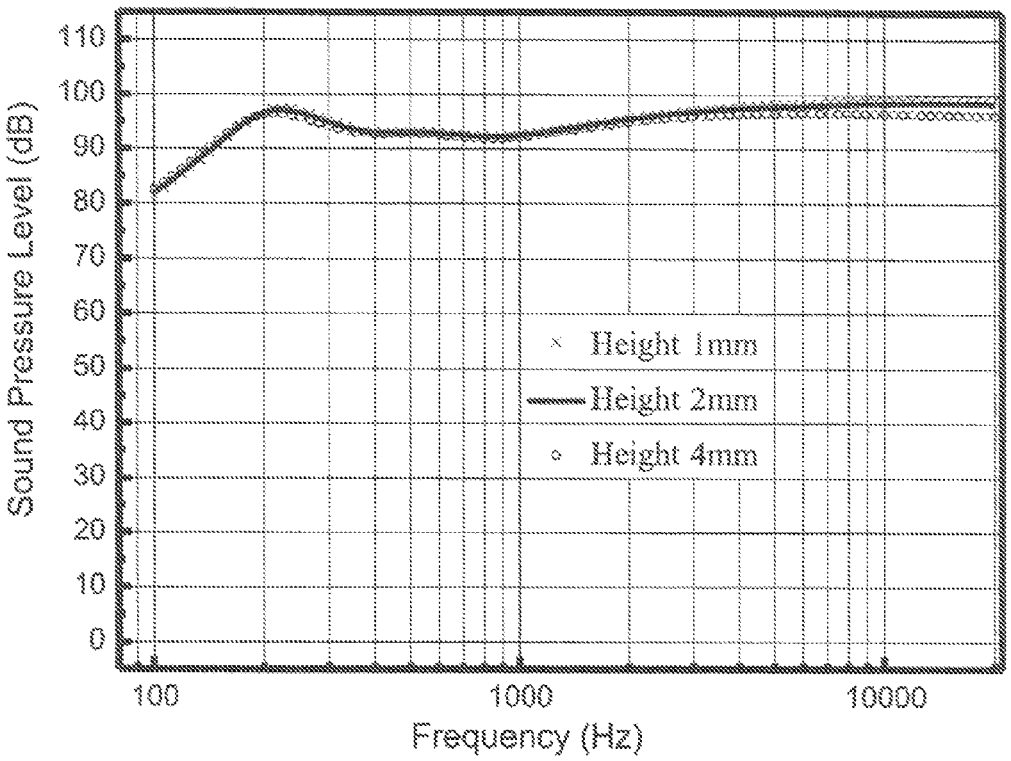
FIGS. 6A-6B are diagrams showing the sound pressure level and total harmonic distortion of a piezoelectric electroacoustic transducer according to embodiments 2, 6, and 7 of the present disclosure.
Figure 6B:
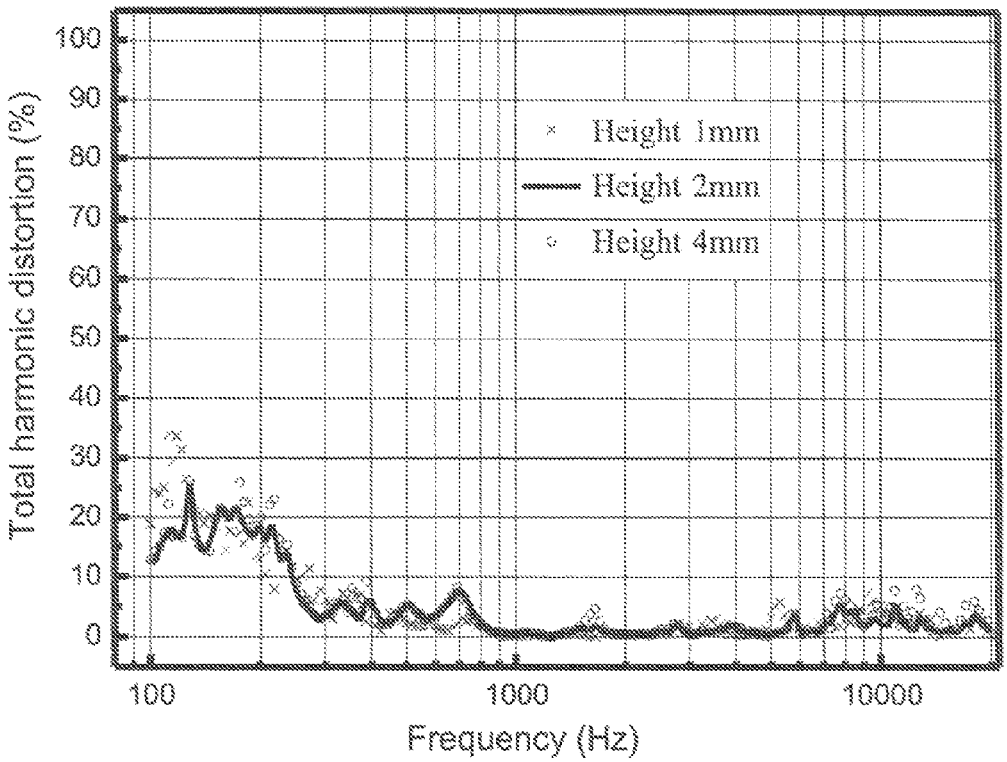

The difference between embodiments 6 and 2 is that the bending structure height is 1 mm. The testing results for the sound pressure level and the total harmonic distortion in the embodiment 6 are shown in FIGS. 6A and 6B, respectively.

Embodiment 7

The difference between embodiments 7 and 2 is that the bending structure height is 4 mm. The testing results for the sound pressure level and the total harmonic distortion in the embodiment 7 are shown in FIGS. 6A and 6B, respectively.

Embodiment 8

Figure 7A:
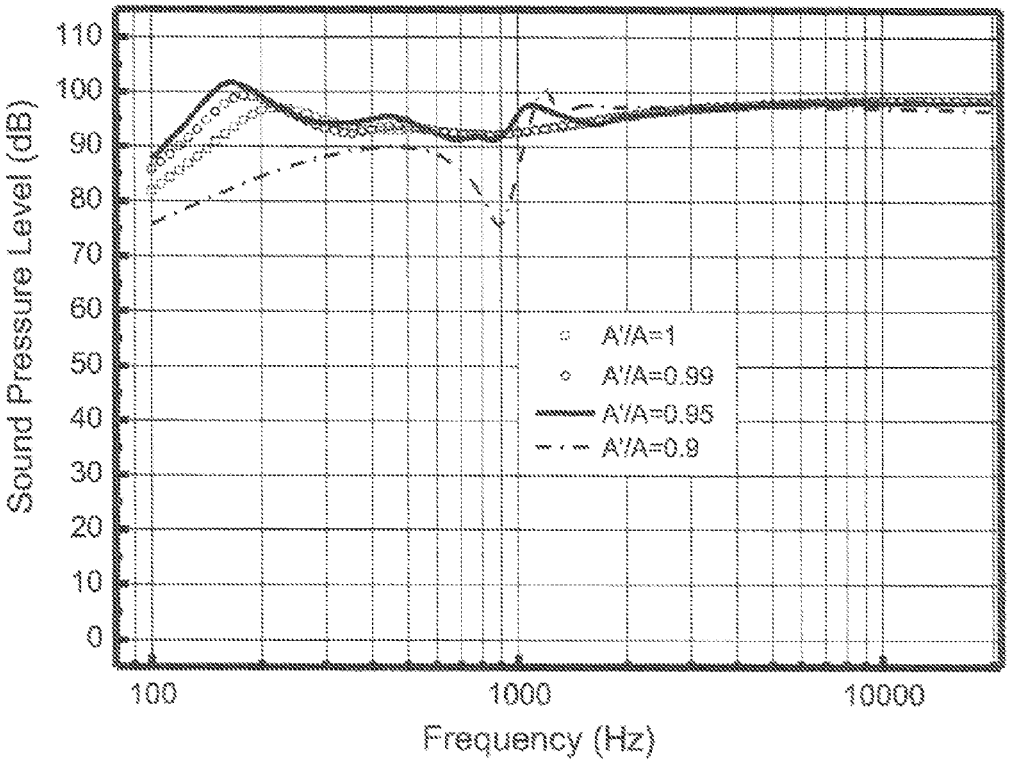
FIGS. 7A-7B are diagrams showing the sound pressure level and total harmonic distortion of a piezoelectric electroacoustic transducer according to embodiments 2, 8, 9, and 10 of the present disclosure.
Figure 7B:
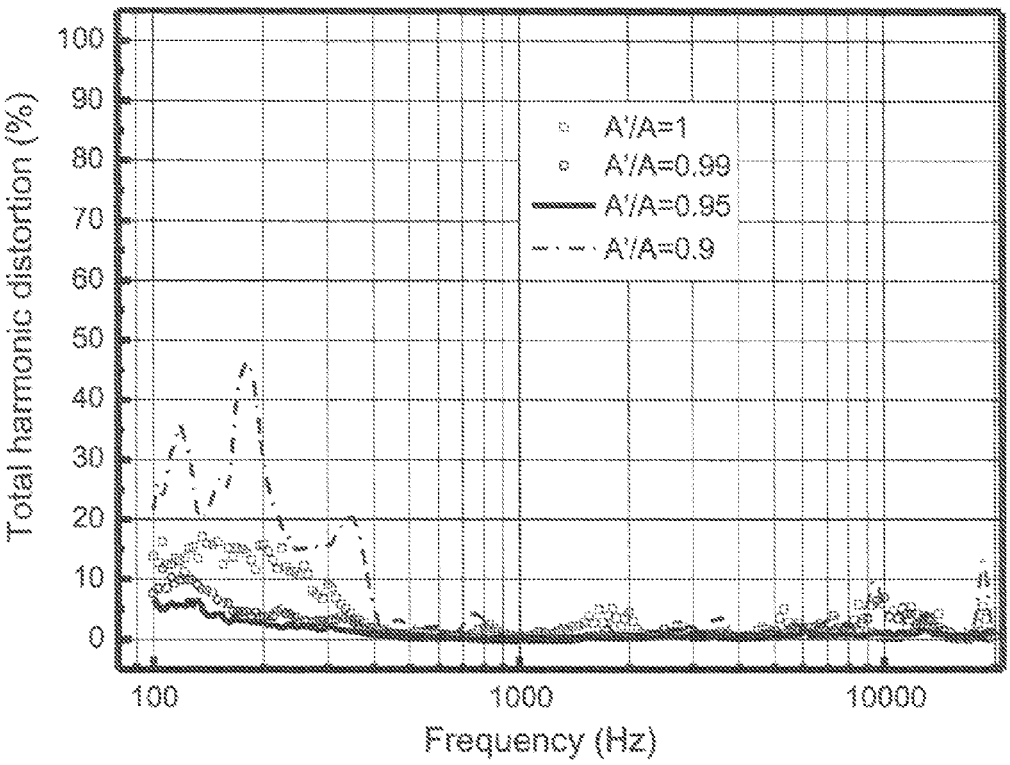

The difference between embodiments 8 and 2 is that the ratio of the inner-frame projected area to the planar projected area of the composition of the diaphragm, the elastic element, and the buffer is 0.99. The testing results for the sound pressure level and the total harmonic distortion in the embodiment 8 are shown in FIGS. 7A and 7B, respectively.

Embodiment 9

The difference between embodiments 9 and 2 is that the ratio of the inner-frame projected area to the planar projected area of the composition of the diaphragm, the elastic element, and the buffer is 0.95. The testing results for the sound pressure level and the total harmonic distortion in the embodiment 9 are shown in FIGS. 7A and 7B, respectively.

Embodiment 10

The difference between embodiments 10 and 2 is that the ratio of the inner-frame projected area to planar projected area of the composition of the diaphragm, the elastic element, and the buffer is 0.9. The testing results for the sound pressure level and the total harmonic distortion in the embodiment 10 are shown in FIGS. 7A and 7B, respectively.

Embodiment 11

Figure 8A:
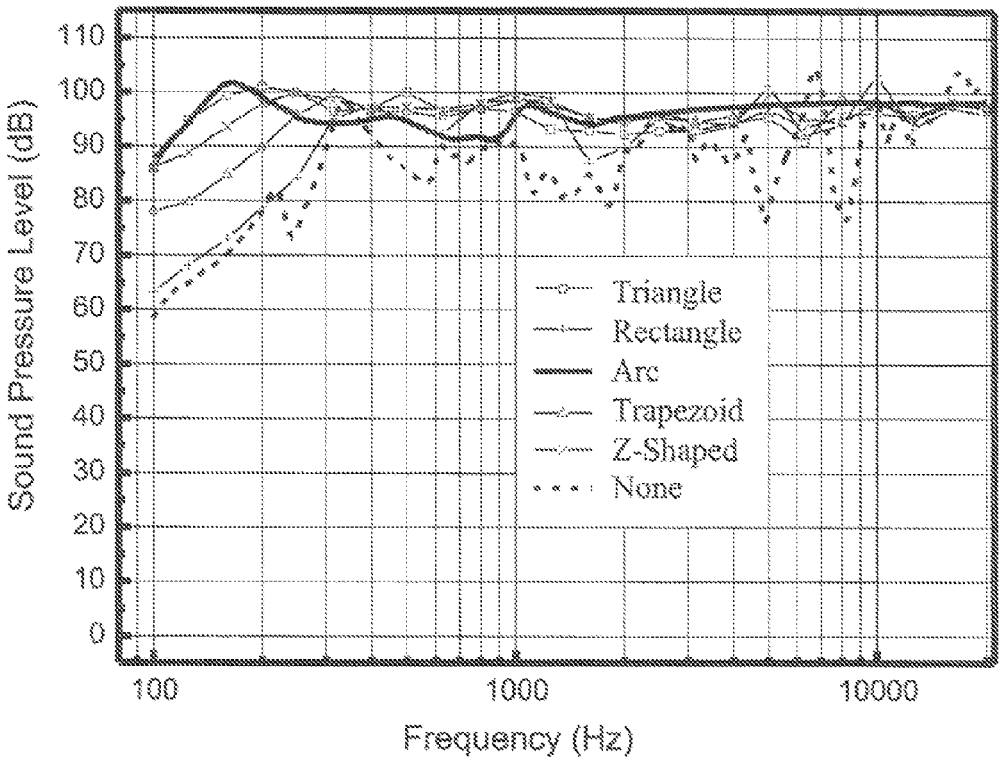
FIGS. 8A-8B are diagrams showing the sound pressure level and total harmonic distortion of a piezoelectric electroacoustic transducer according to embodiments 11, 12, 13, and 14 of the present disclosure.
Figure 8B:
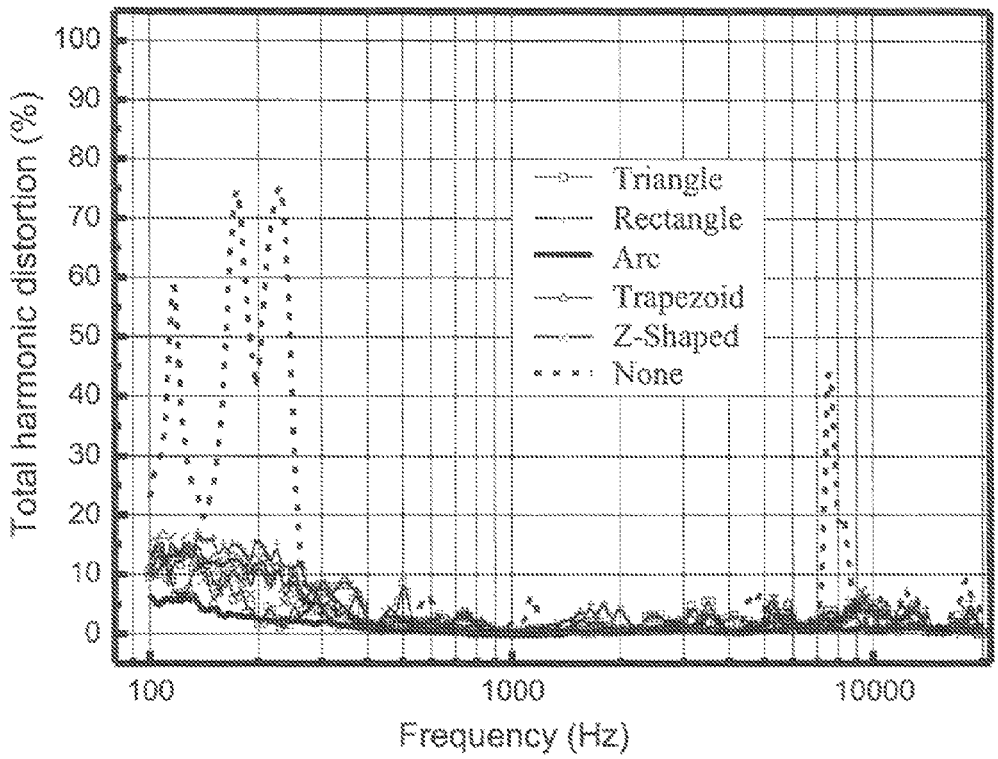

The difference between embodiments 11 and 9 is that the bending structure is triangle. The testing results for the sound pressure level and the total harmonic distortion in the embodiment 11 are shown in FIGS. 8A and 8B, respectively.

Embodiment 12

The difference between embodiments 12 and 9 is that the bending structure is rectangular. The testing results for the sound pressure level and the total harmonic distortion in the embodiment 12 are shown in FIGS. 8A and 8B, respectively.

Embodiment 13

The difference between embodiments 13 and 9 is that the bending structure is trapezoid. The testing results for the sound pressure level and the total harmonic distortion in the embodiment 13 are shown in FIGS. 8A and 8B, respectively.

Embodiment 14

The difference between embodiments 14 and 9 is that the bending structure is Z-shape. The testing results for the sound pressure level and the total harmonic distortion in the embodiment 14 are shown in FIGS. 8A and 8B, respectively.

The following are detailed description for the testing results for the comparative example and embodiments 1 to 14 as mentioned above.

Referring to FIGS. 4A and 4B, shown are the testing results for the sound pressure level (SPL) and the total harmonic distortion in the embodiments 1, 2 and 3 which the bending structure width is 0.5 mm, 1 mm, and 2 mm, respectively.

Referring to FIG. 4A, the drop ripple of the sound pressure level is about ±2 dB between each embodiment. It means the bending structure width is in the range of 0.5 mm-2 mm, and a piezoelectric electroacoustic transducer still has a flat curvature of the sound pressure. However, the resonance frequency is varying with the bending structure width. The resonance frequency slightly decreases to 180 Hz as the bending structure width is narrowed to 0.5 mm. The resonance frequency increases to 240 Hz as the bending structure width is widened to 2 mm.

Referring to FIG. 4B, the total harmonic distortion rises sharply to about 45% at the resonance frequency (about 200 Hz). It is known from the embodiments 1, 2, and 3, the bending structure width affects the diaphragm side stiffness, and an appropriate bending structure width can uphold lower resonance frequency and reduce the distortion.

Referring to FIGS. 5A and 5B, there are the testing results for the sound pressure level (SPL) and the total harmonic distortion (THD) in the embodiments 2, 4 and 5 which the interval of each adjacent bending structure is 10 mm, 8 mm, and 13 mm, respectively. Although there are different interval bending structure of elastic elements as shown in FIG. 5A, the piezoelectric electroacoustic transducer still substantially have flat curvatures of the sound pressure. The resonance frequencies are about 200-230 Hz and the drop ripples of the sound pressure level are about ±2 dB, wherein the less the number of the arc-shape bending structure is, the lower the resonance frequency is. In this embodiment, the resonance frequency is about 200 Hz, and the sound pressure level (SPL) slightly increases of about 2 dB at low frequency.

Referring to FIG. 5B, the total harmonic distortion is less than 15% while the resonance frequency is lower than 200 Hz, and is less than 10% while the resonance frequency is in high frequency.

For the comparative example without any arc-shape bending structure, its sound pressure curvature is showing a greater drop ripple fluctuations (±10 dB). In addition, the resonance frequency also increases to 300 Hz, and the total harmonic distortion increases to about 50% in audio frequency.

It is known from FIGS. 2, 4, and 5 that the piezoelectric electroacoustic transducer according to the present disclosure has elastic element with a plurality of bending structure so as to have low THD and flat SPL curvature.

Referring to FIGS. 6A and 6B, the testing results for the sound pressure level (SPL) and the total harmonic distortion (THD) in the bending structure height (2 mm, 1 mm, 4 mm) in embodiments 2, 6 and 7 are distinct. For different bending structure height, the piezoelectric electroacoustic transducer still has a flat curvature of the sound pressure level as shown in FIG. 6A. When the arc-shaped bending structure height changes, the resonance frequency is about 230 Hz remained, the drop ripples of the sound pressure level are about ±2 dB. When the bending structure width is fixed at 1 mm, slight changes in the bending structure height affect very little in the diaphragm side stiffness. It is the reason that changing the bending structure height has little effect on the sound output of the piezoelectric electroacoustic transducer.

Referring to FIG. 6B, changing the arc-shaped bending structure height relatives of the total harmonic distortion is about 15% while the resonance frequency is lower than 200 Hz, only the one who has a maximum height of 4 mm rose slightly to 30% in the low frequency 100 Hz. The THD is less than 10% in high frequency.

Referring to FIGS. 7A and 7B, the testing results for the sound pressure level (SPL) and the total harmonic distortion (THD) in the ratio (A'/A) of the inner-frame projected area A' to planar projected area A of the composition of the diaphragm, the elastic element, and the buffer (1, 0.99, 0.95, 0.9) in embodiments 2, 8, 9 and 10 are distinct.

Referring to FIG. 7A, the resonance frequency varies significantly with the change of the compressive stress, when the ratio A'/A is equal to 1 (that is no compressive stress), the resonance frequency is 200 Hz, while the ratio A'/A is equal to 0.99 (that is the compressive stress is 5N) then the resonance frequency decreases to 180 Hz, and while the ratio A'/A is equal to 0.95 (that is the compressive stress is about 15N), the resonance frequency decreases to 150 Hz. Therefore the sound pressure with compressive stress significantly increases about 10 dB, as compared with the sound pressure without compressive stress in low-frequency, and the sound pressure level remains flat in high-frequency region. However, when the ratio A'/A is equal to 0.9 (that is the compressive stress is larger than 25N), the resonance frequency and the SPL curvature becomes poor.

Referring to FIG. 7B, the total harmonic distortion reduces to about 5% while slightly giving a little more compressive stress in low frequency 100 Hz. The sound pressure level and total harmonic distortion are getting worse when the diaphragm deformed due to excessive compressive stress.

It is known from the embodiments 2, 8, 9 and 10, the resonance frequency, the SPL curvature and THD could be adjusted by modification of the compressive stress. Furthermore, the sound quality of the present disclosure for piezoelectric electroacoustic transducer could be optimized.

Referring to FIGS. 8A and 8B, the testing results for the sound pressure level (SPL) and the total harmonic distortion (THD) in the bending structure of arc-shaped, triangular, rectangular, trapezoidal, Z-shaped and no bending structure in embodiments 11, 12, 13 and 14 are distinct. It is shown in FIG. 8A, the SPL curvature is substantially a flat curvature for the different shaped bending structures. The drop ripple of the sound pressure level for the arc-shaped and triangle bending structure of about ±2 dB is the smallest. The drop ripple of the sound pressure level for the rectangular bending structure of about ±5 dB is larger.

In addition, the piezoelectric electroacoustic transducer with arc-shaped and triangular bending structure has the lowest resonance frequency. It is 150 Hz for arc-shaped bending structure, 180 Hz for triangular bending structure and 400 Hz for rectangular bending structure. The piezoelectric electroacoustic transducer with rectangular bending structure has the highest resonance frequency.

As shown in FIG. 8B, the test results of the total harmonic distortion are significantly decreased for the piezoelectric electroacoustic transducers with different shaped bending structure which are treated with the appropriate compressive stress. For instance they are around or below 15% in low frequency of 100 Hz, even would decrease to 5% for arc-shaped bending structure.

It is known from the embodiments 11, 12, 13 and 14, the resonance frequency, the drop ripple of the sound pressure level (SPL) and the total harmonic distortion (THD) could be adjusted by modifying the compressive stress from frame to the bending structure and the shape of the bending structure. Furthermore, the sound quality of the present disclosure for piezoelectric electroacoustic transducer could be optimized.

Figure 9:
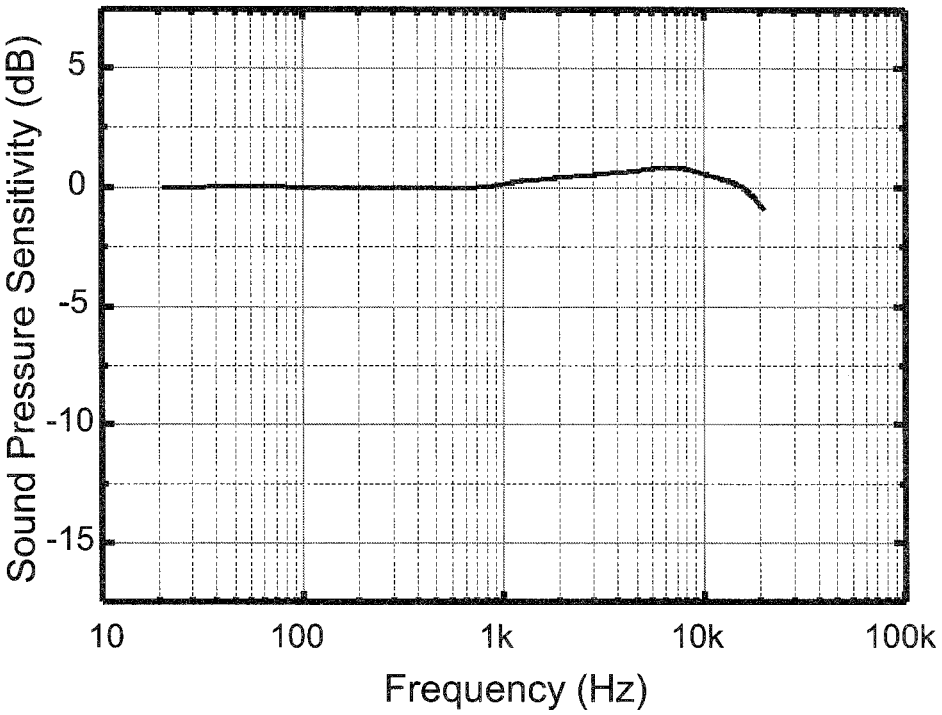
FIG. 9 is a diagram showing a sound sensitivity of a piezoelectric electroacoustic transducer according to the present disclosure.

Furthermore, referring to FIG. 9, the piezoelectric electroacoustic transducer in embodiment 9 may also be implemented as a microphone. A sound receiving testing result for the microphone as illustrated in FIG. 9 shows that, a sound sensitivity of a piezoelectric electroacoustic transducer in most frequency (from about 20 Hz to 20 KHz) is within 1 dB. The piezoelectric electroacoustic transducer as a microphone has an excellent electroacoustic converting capability so as to nearly completely convert sound vibrations into voltage signals.

According to the present disclosure the elastic element with a plurality of bending structure connected with and around the diaphragm and disassemble frame which can adjust the inner-frame projected area such that the frame always provides a compressive stress to the elastic element. The piezoelectric electroacoustic transducer has high SPL, low-frequency gain, flat SPL curvature, and low THD. It may exhibit a speaker function for converting electrical energy into mechanical energy to form sound wave, as well as a microphone function for converting mechanical energy to electrical energy.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A piezoelectric electroacoustic transducer, comprising
- a diaphragm,
- a piezoelectric element disposed on the diaphragm,
- an elastic element perpendicular to the diaphragm and connected with and around the diaphragm,
- a frame disposed around the elastic element, and
- a buffer interposed between the elastic element and the frame,
- wherein the frame has an inner-frame projected area less than a planar projected area of the diaphragm, the elastic element, and the buffer, such that the frame always provides a compressive stress to the diaphragm, the piezoelectric element, the elastic element, and the buffer.

2. The piezoelectric electroacoustic transducer of claim 1, wherein the frame is disassembled so as to adjust the inner-frame projected area of the frame.

3. The piezoelectric electroacoustic transducer of claim 1, wherein a ratio between the inner-frame projected area and the planar projected area is between 0.9 and 1.

4. The piezoelectric electroacoustic transducer of claim 1, wherein the elastic element comprises a plurality of bending structures that are spaced at an interval less than or equal to one-third of a perimeter of the diaphragm.

5. The piezoelectric electroacoustic transducer of claim 1, wherein the elastic element comprises a plurality of bending structures that are spaced at an interval of 8 mm-13 mm.

6. The piezoelectric electroacoustic transducer of claim 1, wherein the elastic element is 0.5 mm-2 mm in width.

7. The piezoelectric electroacoustic transducer of claim 1, wherein the elastic element is 1 mm-4 mm in height.

8. The piezoelectric electroacoustic transducer of claim 1, wherein the elastic element comprises a plurality of bending structures that are arc-shaped, triangular, rectangular, trapezoidal, or Z-shaped.

9. The piezoelectric electroacoustic transducer of claim 1, wherein the diaphragm is circular, rectangular or elliptical.

10. The piezoelectric electroacoustic transducer of claim 1, wherein the diaphragm has a single-layer structure or a multi-layer structure.

11. The piezoelectric electroacoustic transducer of claim 1, wherein the piezoelectric element is circular, rectangular or elliptical.

12. The piezoelectric electroacoustic transducer of claim 1, wherein the buffer comprises pressure sensitive rubber, elastic rubber, foam, or any combination thereof.

13. The piezoelectric electroacoustic transducer of claim 1, further comprising a sealing membrane that covers a portion of the diaphragm and the frame so as to seal a gap between the diaphragm and the frame.

14. A piezoelectric electroacoustic transducer, comprising a diaphragm, a piezoelectric element disposed on the diaphragm, a plurality of bending structures perpendicular to the diaphragm and connected with and around the diaphragm, a frame disposed around the bending structures, and a buffer interposed between the bending structures and the frame, wherein the frame has an inner-frame projected area less than a planar projected area of the diaphragm, the bending structures, and the buffer, such that the frame always provides a compressive stress to the diaphragm, the piezoelectric element, the bending structures, and the buffer.

15. The piezoelectric electroacoustic transducer of claim 14, wherein the plurality of bending structures are spaced at an interval less than or equal to one-third of the perimeter of a diaphragm.

16. The piezoelectric electroacoustic transducer of claim 14, wherein the buffer comprises pressure sensitive rubber, elastic rubber, foam, or any combination thereof.

17. The piezoelectric electroacoustic transducer of claim 14, wherein the bending structure is 0.5 mm-2 mm in width.

18. The piezoelectric electroacoustic transducer of claim 14, wherein the bending structure is 1 mm-4 mm in height.

19. The piezoelectric electroacoustic transducer of claim 14, wherein the bending structures are spaced at an interval of 8 mm-13 mm.

20. The piezoelectric electroacoustic transducer of claim 14, further comprising a sealing membrane that covers a portion of the diaphragm and the frame so as to seal a gap between the diaphragm and the frame.

* * * * *